United States Patent [19]

Pozo

[11] Patent Number: 4,545,058

[45] Date of Patent: Oct. 1, 1985

[54] ELECTRIC FURNACE REFRACTORY ROOF FORM

[75] Inventor: Jaime F. Pozo, Chicago, Ill.

[73] Assignee: AMSTED Industries Incorporated, Chicago, Ill.

[21] Appl. No.: 561,661

[22] Filed: Dec. 15, 1983

[51] Int. Cl.[4] ..... F27D 1/00

[52] U.S. Cl. ..... 373/73; 432/250

[58] Field of Search ..... 110/331, 332; 373/71, 373/73, 74; 432/237, 247, 250

[56] References Cited

U.S. PATENT DOCUMENTS

| | | | |
|---|---|---|---|
| 1,922,312 | 8/1933 | Mansfield | 373/74 |
| 3,293,346 | 12/1966 | Rumberg et al. | 373/73 |
| 4,146,742 | 3/1979 | Longenecker | 373/74 |
| 4,151,362 | 4/1979 | Hart | 373/73 |
| 4,273,949 | 6/1981 | Fisher et al. | 373/74 |
| 4,425,656 | 1/1984 | Kuhlmann | 373/74 |
| 4,445,220 | 4/1984 | Kuhlmann | 373/74 |

FOREIGN PATENT DOCUMENTS

| | | | |
|---|---|---|---|
| 2048445 | 12/1980 | United Kingdom | 373/74 |

*Primary Examiner*—Reinhard J. Eisenzopf
*Assistant Examiner*—Gregory D. Thompson
*Attorney, Agent, or Firm*—Charles E. Bouton; Edward J. Brosius

[57] ABSTRACT

A form for constructing a refractory roof for an electric arc furnace having a provision for selectively changing the electrode opening pattern and also forming a roof of different diameters.

6 Claims, 9 Drawing Figures

ELECTRIC FURNACE REFRACTORY ROOF FORM

FIELD OF THE INVENTION

The present invention relates to electric arc furnaces and more particularly to a form for constructing a refractory roof for electric furnaces.

BACKGROUND OF THE INVENTION

Electric arc furnaces are constructed with a domed roof consisting essentially of silica or refractory block embraced at the base with a metallic furnace roof ring. The roof is generally dome shaped and has a plurality of openings through which the furnace electrodes extend. The pattern or arrangement of the electrodes may vary among the various furnace manufactureres or different size furnaces so that different roof opening patterns are required.

The furnace roofs gradually deteriorate during use and must be replaced. The replacement roof structure is constructed on-site on a form and the roof is lifted into place on the furnace top. Heretofore it has been commom practice to provide a different roof form for each different size roof or electrode pattern arrangement. A separate form for each different roof size and pattern arrangement is space consuming and expensive.

SUMMARY OF THE PRESENT INVENTION

By the present invention it is proposed to provide a form for constructing refractory roofs for electric furnaces which can be used to construct roofs of different diameters or different electrode patterns.

This is accomplished by a structure comprising a preformed base having a generally spherical dome. A recess is formed in the dome to accommodate replaceable insert means having predetermined angularly spaced cut outs which co-act with the walls of the recess to accommodate plugs. The plugs provide a guide about which refractory bricks are laid to provide a predetermined electrode opening pattern in the domed roof for receiving the electrodes upon removal of the plugs. A roof ring is disposed about the base periphery of the form to retain the refractory bricks in the domed configuration. Upon completion of the refractory roof the entire roof assembly including the roof ring is lifted into place and fastened to the top of the electric furnace in the usual manner.

In order to accommodate different diameter furnace tops on which the roof is placed the form is provided with a base peripheral flange to which the ring is detachably fastened prior to the construction of the roof. A separable annular ring is positionable on the peripheral flange to provide a roof ring support which defines a dome having a diameter less than the diameter of the first mentioned roof.

Further features of the invention will be apparent from the following specification.

DESCRIPTION OF THE PREFERRED EMBODIMENT

Figure 1:
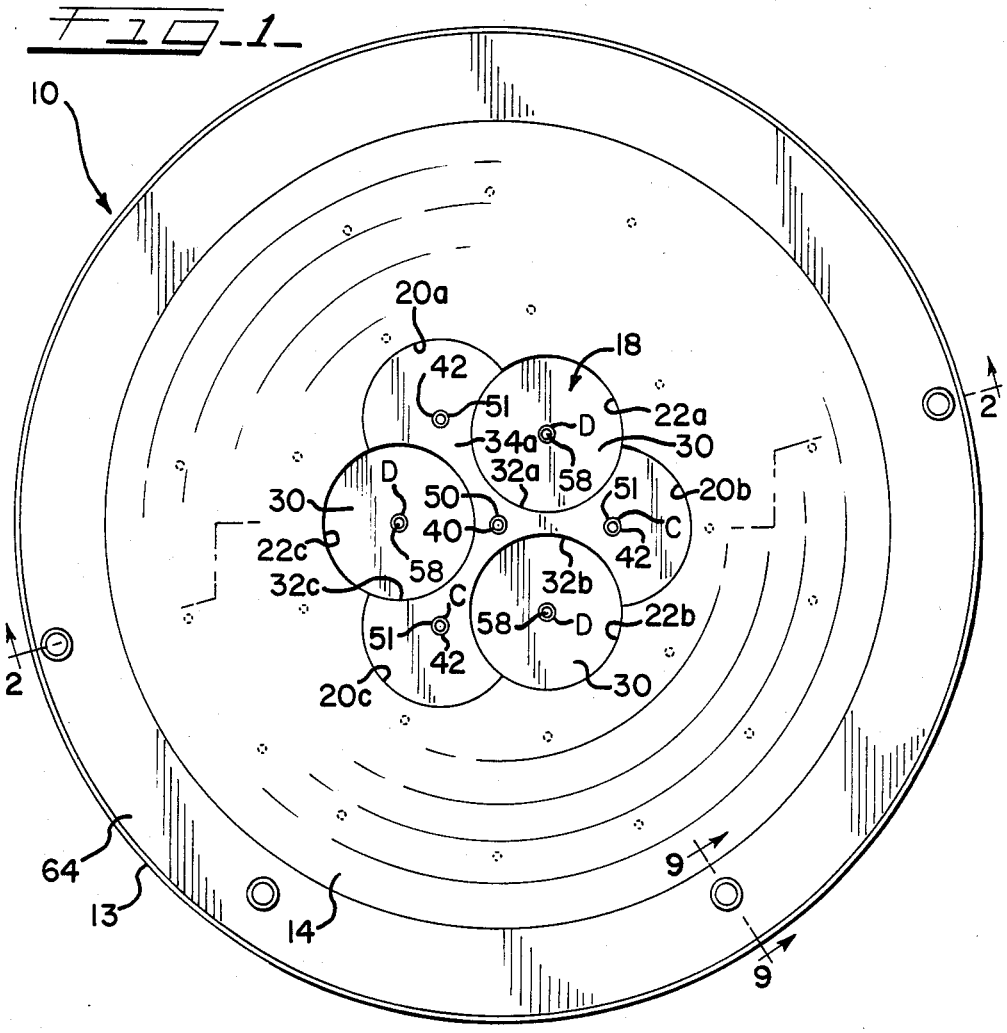
FIG. 1 is a top plan view of the form for constructing an electric furnace refractory roof in accordance with the present invention showing one form of electrode pattern insert position thereon.
Figure 2:
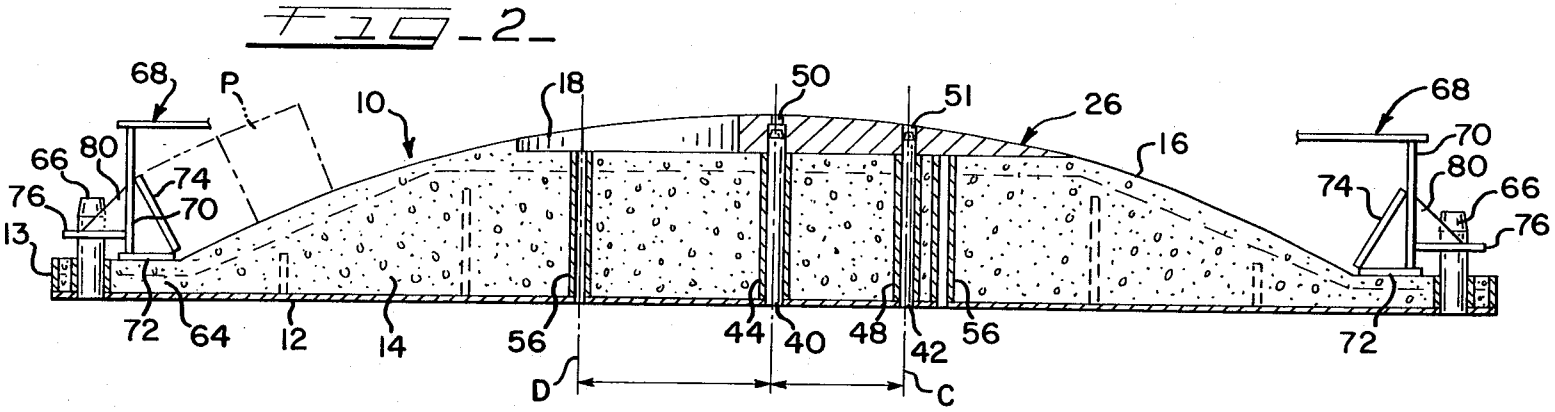
FIG. 2 is a cross sectional view of the form taken generally along the lines 2—2 of FIG. 1.

Referring now to FIGS. 1 and 2 there is shown the form 10 for constructing a refractory roof for an electric arc furnace. The form 10 comprises a circular metal base 12 having an upstanding flange 13. Concrete is poured in the base 12 to form a body 14 having an upper convex or dome support surface 16 on which refractory blocks R may be placed to form a roof.

Figure 3:
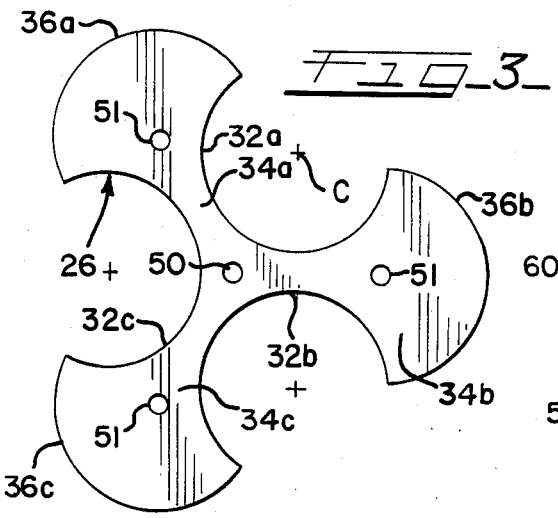
FIG. 3 is one embodiment of an insert used to determine the electrode opening pattern in the roof.
Figure 6:
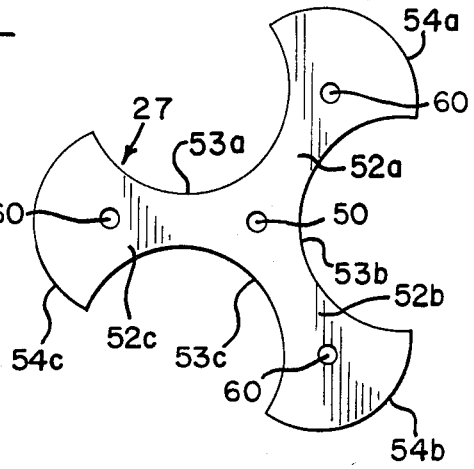
FIG. 6 is a fragmentary top plan view of a second form of electrode pattern insert.
Figure 4:
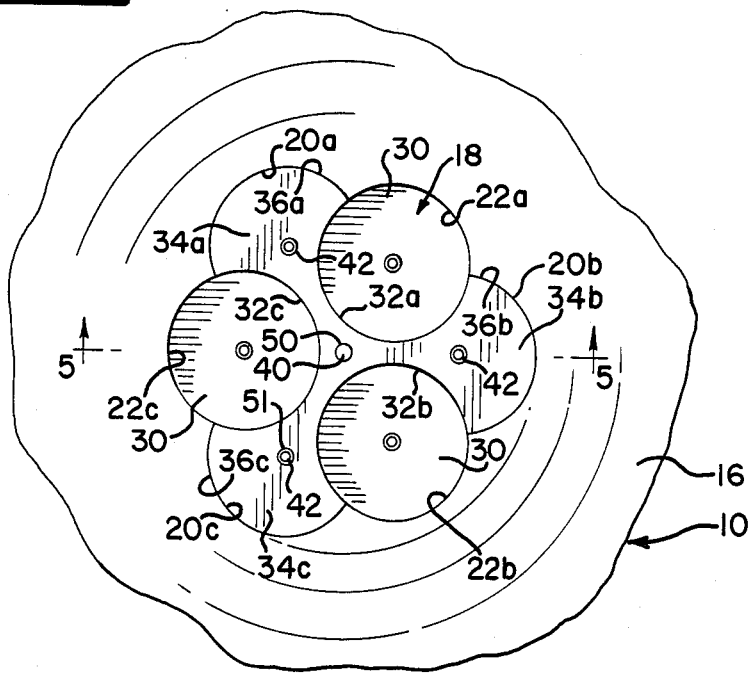
FIG. 4 is a fragmentary top plan view of FIG. 1 showing the electrode pattern insert.

A recess 18 is formed in the domed surface 16 at the top thereof. As shown the recess is formed with two sets of three intersecting arc-like scallop edges 20*a*, 20*b*, 20*c* and 22*a*, 22*b*, 22*c* respectively The scallop edges 20*a*, 20*b* and 20*c* each are of equal radius of which the centers C lie on a common circle. Similarly the scallops 22*a*, 22*b* and 22*c* are of equal radius and the centers D lie on a common circle. The radius of the scallops 20*a*, *b* and *c* is different than the radius of the scallops 22 *a*, *b*, and *c*. In this manner a scalloped edge depression 18 is formed in the dome. One of two different inserts 26 or 27 as shown in FIGS. 3 and 6 respectively, is accommodated within the depression 18. As shown in FIGS. 1, 3, 4 and 5 the insert is formed with equi-angularly spaced partial circular cut-outs 32*a*, 32*b* and 32*c* located between equi-angular spaced radial arms 34*a*, 34*b* and 34*c*. The radial arms 34*a*, 34*b* and 34*c* terminate in arcuate edges 36*a*, 36*b* and 36*c* having a radius equal to the radius of the scalloped edges 20*a*, 20*b* and 20*c* so as to be seated therein. As shown in FIG. 4 partial circular cut-outs 32*a*, 32*b* and 32*c* are completed by the scalloped edges 22*a*, 22*b* and 22*c* to form a plurality of radially spaced circular recesses 30. The recesses are adapted to receive plugs (not shown) which serve in the nature of cores and about which the refactory brick R is laid to form a roof for an electric furnace as is conventional.

To assure the correct alignment of the insert 26 there is provided a substantially axially located guide pin 40 which projects above the recessed surface and diametrical spaced guide pins 42. Equi-spaced at about 120° the guide pins 40 and 42 are removably located in sleeves 44 and 48, respectively, embedded in the concrete base 14. The guide pins 40 and guide pins 42 project and seat in complementary located openings 50 and 51 formed in the radial arms 34*a*, 34*b* and 34*c* of the insert 26.

The inserts 26 and 27 may be made of any light weight material such as wood, aluminum or the like to facilitate installation and removal of the insert 26 for replacement with the insert 27.

Figure 8:
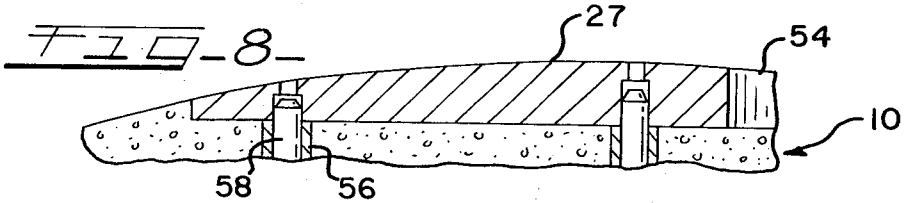
FIG. 8 is a cross-sectional view taken generally along the lines 8—8 of FIG. 7.
Figure 7:
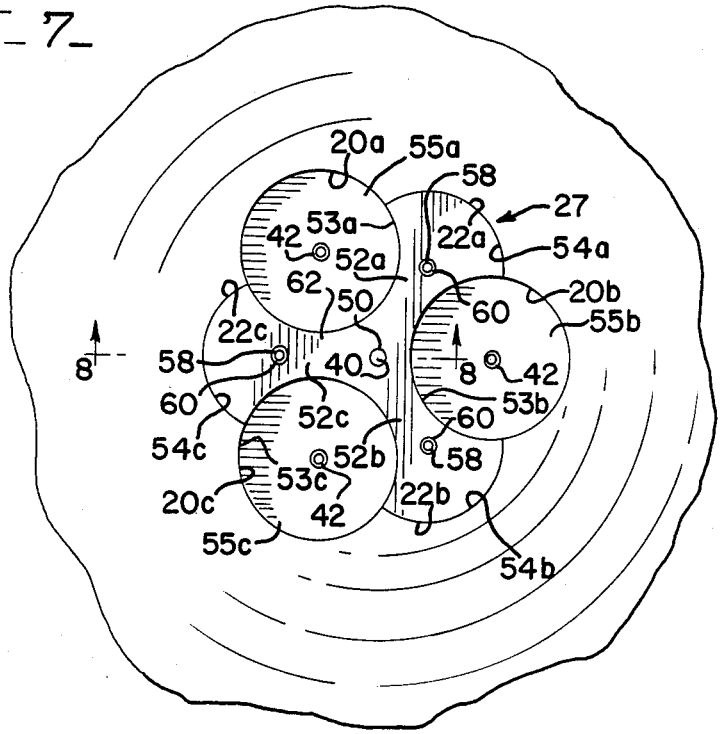
FIG. 7 is a fragmentary top plan view of the form showing the second form of electrode pattern insert positioned thereon.

The insert 27 as shown in FIGS. 6, 7 and 8 is formed with radial arms 52*a*, 52*b* and 52*c* defining partial circular cut-outs 53*a*, 53*b* and 53*c*. The arms 52*a*, 52*b* and 52*c* are equi-angularly spaced and have circular edges 54*a*, 54*b* and 54*c* merge with the scalloped edges 22*a*, 22*b* and 22*c* to form a different pattern of openings 55*a*, 55*b* and 55*c* which receive the plugs (not shown) about which the refractory brick is laid as described above.

The concrete base 14 has embedded therein three sleeves 56 equi-angularily spaced and removably received guide pins 58. The center of guide pins 58 lie on a common circle having a diameter different from the diameter on which the centers C of the guide pins lie.

The guide pins 58 are received in locating openings 60 formed in the arms 52*a*, 52*b*, 52*c* of the insert 27. In this manner the insert 27 is located and fixed against rotation so as to maintain the integrity of the plug openings 55*a*, 55*b* and 55*c*.

The form 10 includes a circumferential horizontal flange 64 in which there is embedded a plurality of angularly spaced roof ring guide pins 66 for supporting a roof ring 68. The roof ring 68 comprises an upstanding wall 70 fixed at its lower end as by welding to a base plate 72. Diagonally extending between and fixed to the free end of the base plate 72 and the upstanding wall 70 is a refractory support plate 74 which defines with the base and upstanding walls 70 and 72 a water or coolant chamber. The diagonal wall or plate 74 provides support for the refractory brick laid on the dome.

Projecting from the outboard face of the upstanding wall 70 is a ring attachment bracket including a horizontally projecting plate 76 having an opening which accommodates the roof guide pin 66. Reinforcing the plate 74 are gussets 80.

Figure 9:
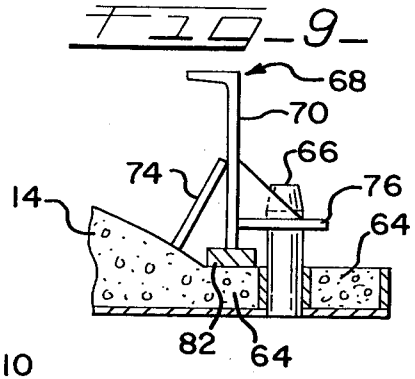
FIG. 9 is a fragmentary cross-sectional view showing a roof ring mounted to form a roof of smaller diameter than the roof shown in FIG. 1.
Figure 5:
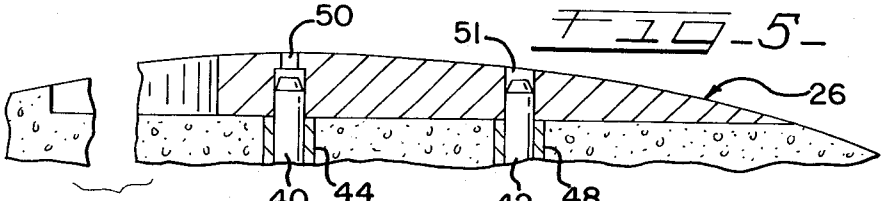
FIG. 5 is a fragmentary cross-sectional view taken generally along the lines 5—5 of FIG. 4.

In the position shown the roof ring is disposed on the form with the base plate 72 in direct engagement with the peripheral flange 64. When in this position the roof ring 68 serves to permit the formation of a refractory roof of maximum diameter on the form 10. Should, however, a small diameter roof be required an annular elevating spacer 82 as shown in FIG. 9 is located on the flanges 64. This results in forming a dome of smaller diameter on the surface 16.

After the refractory brick roof has been laid the assembled roof including the roof ring is hoisted and separated from the underlying roof form 10. The lifting is performed preferably prior to hoisting the plugs (not shown) in the openings 30 depending on which insert 26 or 27 is in the depression 18 of the body 14. The refactory brick roof including the roof ring is then lowered into position on the electric arc furnace and the electrodes are inserted through the openings in the well known manner.

What is claimed is:

1. A form constructing a refractory roof for an electric furnace, said form comprising a preformed base having a dome upper surface, an axial recess in said upper surface defined by a plurality of arcuate edges forming a scallop periphery, an insert replaceably seated in said recess and having angular spaced circular cut outs arranged to cooperate with selective ones of arcuate edges to define an enclosed angularly spaced recess corresponding to the electrode pattern of the furnace with which said roof is used.

2. The invention as defined in claim 1 wherein said arcuate edges defining said scallop periphery are an arc of circles.

3. The invention as defined in claim 2 wherein said arcs forming said arcuate edges include a first set of three arcs of equal radii and a second set of three arcs of equal radii greater than the radius of said first set, said arcs of each set being located between and intersecting two arcs of the other of said sets.

4. The invention as defined in claim 3 wherein said angular spaced cut outs in said insert is an arc having a radius equal to one of said radius of said arcuate edges so as to form recessed circular openings therewith.

5. The invention as defined in claim 4 wherein said base and insert including locating means aligning said insert in said axial recess with a set of arcuate edges of equal radius.

6. The invention as defined in claim 1 wherein said preformed base includes a peripheral flange about the base thereof supporting a refractory brick roof ring, to form a roof of a refractory given diameter, and removable means supportable on said base elevating said roof ring whereby a brick refractory roof of smaller diameter than said first mentioned refractory roof of given diameter may be formed on said flange.

* * * * *